United States Patent [19]

Poltash

[11] Patent Number: 4,809,416

[45] Date of Patent: Mar. 7, 1989

[54] METHOD OF MAKING COSTUME JEWELRY RESEMBLING BLACK HILLS GOLD

[76] Inventor: Lawrence M. Poltash, 517 3rd St., Manhattan Beach, Calif. 90266

[21] Appl. No.: 63,269

[22] Filed: Jun. 17, 1987

[51] Int. Cl.[4] ..... B21F 43/00

[52] U.S. Cl. ..... 29/160.6; 63/2; 63/15

[58] Field of Search ..... 29/160.6, 460; 63/2, 63/15, 29.1

[56] References Cited

U.S. PATENT DOCUMENTS

| | | | |
|---|---|---|---|
| 442,757 | 12/1890 | Schlosstein | 63/29.1 |
| 460,103 | 9/1891 | Banghart | 63/15 |
| 1,851,128 | 3/1932 | Rabinowitz | 63/15 |
| 3,509,734 | 5/1970 | Lederer | 63/15 |
| 3,605,438 | 9/1971 | Chalson | 63/29.1 |
| 4,311,026 | 1/1982 | Ochoa | 29/160.6 |

*Primary Examiner*—P. W. Echols

*Attorney, Agent, or Firm*—Ladas & Parry

[57] ABSTRACT

The present invention relates to a method of making a costume jewelry equivalent of jewelry bearing colored leaves and grapes on its surface. The method involves the forming of a brass base and ornaments both being formed with connecting parts for easy assemblage. The connecting parts comprise studs and corresponding openings. The base is plated in gold. The ornaments are etched and plated in a gold alloy, and the ornaments and base are then connected together.

5 Claims, 3 Drawing Sheets

METHOD OF MAKING COSTUME JEWELRY RESEMBLING BLACK HILLS GOLD

BACKGROUND

Black Hills Gold jewelry is believed to have first been made more than 100 years ago when prospectors came to the Black Hills of South Dakota. The jewelry was and is comprised of a base of gold which is connected to leaves and grapes made from an alloy of gold. The alloying of these ornamental pieces causes them to be pink, yellow and green in color.

To create the ornamental leaves and grapes, twenty-four karat gold is used and combined with a special formulation of other metals to create alloys having distinctive colors. The alloy is flattened into a sheet and the sheets stamped out into leaves, grape clusters, and ring shanks. Some of the designs require the use of a process known as "lost wax" casting. For each piece of jewelry to be cast, a model is made to exact specifications. A rubber mold is then created from the model and hot wax is injected into the mold. The wax patterns are mounted on a rubber base and surrounded by a stainless steel cylinder. A plaster-like material then called an "investment" is poured around the wax patterns. The cylinder is next placed into an oven and baked long enough to melt the wax and create a cavity that is the exact duplicate of the original pattern. The cavity is then injected with molten gold.

When all the parts for a piece of jewelry are ready, a trained craftsperson solders them together with a gold solder. The solder must be carefully placed to secure the parts together without detracting from the design of the jewelry.

After soldering, the piece of jewelry is electroplated and the alloyed gold, which is generally pink, or green is textured to give it a frosty appearance. The texturing step removes the twenty-four karat yellow gold plating from the pink and green leaves allowing the true colors to come through.

Finally, a skilled engraver details the leaves and grapes with hand engraving tools. The result is a beautiful piece of jewelry that has taken a great deal of time to produce and which as a result, is relatively expensive to purchase. The present invention discloses a method of producing a piece of jewelry that is as attractive as that described above, but which omits the necessity of employing a skilled craftsperson to attach the ornaments to the jewelry. It also discloses a process by which the jewelry base and leaves are formed of brass. The base is plated with yellow gold, the ornamental leaves are etched and plated in green or rose alloy. Then the ornaments are attached to the jewelry base. This process is less time consuming and less costly resulting in a less expensive product. The present invention yields a piece of jewelry that is the costume jewelry equivalent of the "Black Hill's Gold Creations". (Black Hills Gold Creations is a registered trademark.)

It is notable that ornaments have been attached to jewelry by means of threaded studs or swedging. While these techniques also eliminate the need of a skilled craftsperson for the soldering of the ornaments to the jewelry base, they result in a poor, nondurable means of attachment. The threaded studs, through time, turn their way free of the jewelry base as the jewelry is exposed to natural jarring and mishandling during wear or storage. The swedged attachment similarly fails, as the widened stud wears free due again to frictional movement of the ornaments with respect to the jewelry base. These failings are not evident in the attachment means disclosed herein.

SUMMARY OF THE INVENTION

The present invention includes the method of forming a piece of jewelry comprising the steps of:

forming a brass base defining at least one opening, said opening having a cross sectional shape;

forming at least one brass ornament defining at least one connecting means in its surface, said connecting means having a cross sectional shape corresponding to said cross sectional shape of said opening for tight engagement therewith;

etching at least said ornaments;

plating with a gold alloy at least said brass ornament;

plating with gold said brass base;

inserting said connecting means in said opening to connect said ornament to said base; and connecting said connecting means within said opening.

DESCRIPTION OF DRAWINGS

FIG. 4—is a second embodiment of a cross-sectional view of

FIG. 1 taken along line 2—2 disclosing the means of connecting the jewelry base to the top ornamentation.

DETAILED DESCRIPTION

Figure 1:
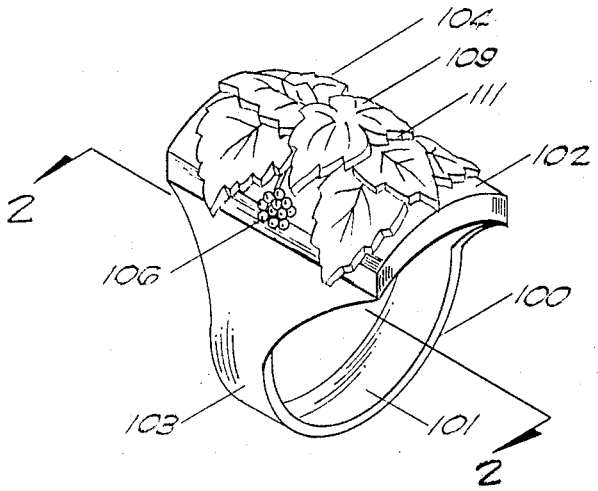
FIG. 1—is a perspective view of a piece of costume jewelry.

Referring first to FIG. 1, a piece of costume jewelry is shown which has been made in accordance with the present invention. This piece of costume jewelry consists of three parts. The first part is the base 100. Base 100 is a ring made of brass that is preferably cast to have a standard circumferential inner surface 101 for fitting around one's finger, an outer surface 103, and a top support section 102 formed in outer surface 103, for carrying ornamental leaves 104 and grapes 106. After being cast, it is polished and plated in gold.

Figure 2:
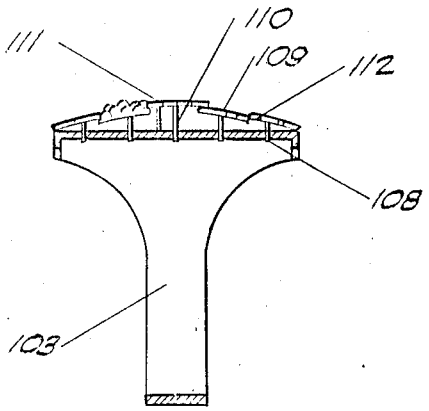
FIG. 2—is a cross-section of FIG. 1 showing a first embodiment of the means of connecting the jewelry base to the top ornamentation.
Figure 3:
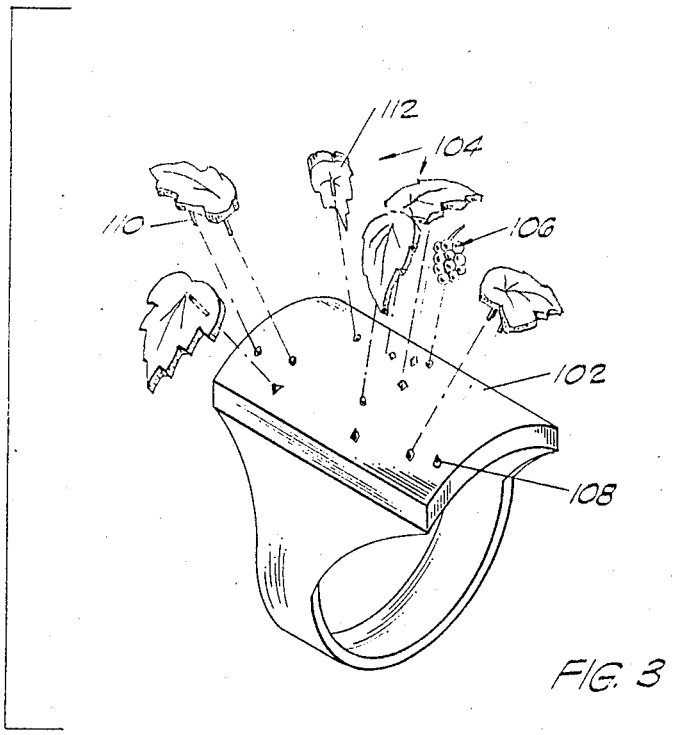
FIG. 3—is an exploded view of FIG. 1.
Figure 4:
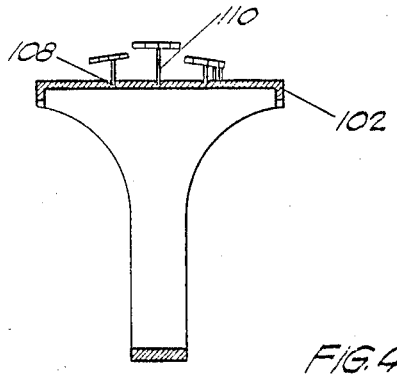

Top support 102, as better seen in FIGS. 2, 3, and 4, is formed with a plurality of openings 108. As shown in FIG. 2, openings 108 may extend completely through top support 102 to inner surface 101, or as shown in FIG. 4, a second embodiment, openings 108 may extend only partially through top support 102. Further, and as shown by way of example only in FIG. 3, openings 108 may be circular, oblong, hexagonal, square, round, or any other shape. FIG. 3 discloses but a few shapes available. The choice of shape will facilitate the solid attachment of the ornaments to the jewelry base as is discussed in more detail further on herein.

The second major portion of FIG. 1 consists of ornamental leaves 104 and grapes 106 each having faces 109, sides 111, and undersides 112. These decorative pieces are cast of brass, hand cut in design, and then plated in a gold alloy to give them their distinctive green, or pink color or plated in gold for a yellow color. Preferably, leaves 104 and grapes 106 are formed with studs 110 on undersides 112. As shown in Figures 3 and 4, each leaf or grape underside 112 may be formed with one and preferably with two or more studs 110, the studs 110 conforming in cross section to the cross section of openings 108 for fitting engagement therewith. If only one stud is used, it is preferable that it be noncircular in cross section to facilitate its gripping engagement with an opening 108 of corresponding shape.

Studs 110 comprise the third major portion of the present invention. By being formed as a part of leaves 104 and grapes 106, they are strongly connected thereto. The cross section of studs 110 correspond with the shape of openings 108 for tight engagement therewith and are of sufficient length to enter and form a good connecting relationship with opening 108. Thse features can be seen clearly in FIGS. 2 and 4.

To attach leaves 104 and grapes 106 to top support 102, studs 110 are inserted into opening 108. Prior to this insertion step, a small amount of glue, solder or other adhesive material is preferably used to secure openings 108 and studs 110 together. Undersides 112 then face generally top support 102. This manner of attachment is much less time consuming than the method of gold soldering used in traditional jewelry of this nature in that it avoids the necessity of finding a skilled craftsperson to solder leaves 104 or grapes 106 to top support 102 so that the aesthetic appearance of the jewelry is not marred. Because of this simple means of attachment, the piece of jewelry can be mass produced and sold at a substantially lesser price.

Figure 5:
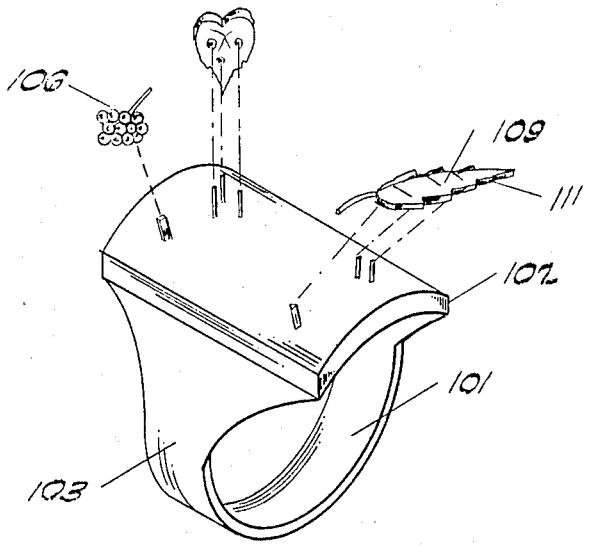
FIG. 5—is an exploded view of FIG. 1 showing a third embodiment for connecting the jewelry base to the top ornamentation.

FIG. 5 discloses a third embodiment of the present invention. Here, base 100 is preferably molded such that top support 102 includes studs 110. Shown in FIG. 5 by way of example only, studs 110 may take on various configurations. In FIG. 5 and as better seen in FIG. 6, underside 112 of leaf 104 is cast with at least one and preferrably two or more openings 108 for receipt of a corresponding number of studs 110. Again, openings 108 correspond in cross section to studs 110 for solid engagement therewith. To connect leaf 108 to top support 102, the stud 110 is inserted into opening 108. Preferably glue, solder or other adhesive material is first placed on the stud or in the opening to secure opening 108 and stud 110 together.

Figure 6:
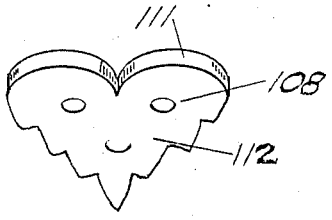
FIG. 6—is a perspective view of the underside of one of the ornaments shown in FIG. 5.

As discussed with regard to FIGS. 1 through 4, the jewelry shown in FIGS. 5 and 6 is initially cast of brass. The base is then polished and plated in yellow gold. The leaves and grapes are etched after casting and then plated in green or rose gold.

The foregoing description and drawings is meant for example only. The present invention contemplates the formation of other pieces of jewelry, such as earrings, necklaces, pendants, pins, cuff links and the like. It also contemplates other decorative pieces being attached to top support 102. Some examples might be stones, gems and various other shaped metal alloys, such as flowers, bufferflies, and appealing aesthetic designs. As noted earlier herein, while it is preferable to form the aesthetic attachments, such as leaves 104 and grapes 106 with studs 110 or support 102 with studs 110, it is equally in the contemplation of the present invention that studs 110 be formed separately and then attached to these pieces. Also as mentioned earlier, various cross sectional shapes of the studs and openings may be used to better facilitate the firm and long lasting connection between top support 102 and decorative ornaments 104 and 106. Further, while it is shown to form the grapes separately of the base, the base can be cast to include the grapes so that they need not be separately attached. In such a case, the grapes are plated with gold along with the base. Finally, etching the base before plating it with gold is also contemplated within this invention.

The following is claimed:

1. The method of forming a piece of jewelry comprising the steps of:

forming a brass base definng at least one opening in its surface, said opening having a cross-sectional shape;

forming at least one brass ornament defining at least one connecting means in its surface, said connecting means having a cross-sectional shape corresponding to that of said cross sectional shape of said opening for tight engagement therewith;

etching at least said ornament;

plating with a gold alloy said brass ornament;

plating with gold said base; and inserting said connecting means in said opening to connect said ornament to said base to form a piece of Black Hills Gold jewelry.

2. The method of claim 1 further comprising the step of soldering said connecting means within said opening.

3. The method of claim 1 further comprising the step of using an adhesive to secure said connecting means within said opening.

4. The method of claim 1 wherein in said step of forming said base, said base is cast and wherein in said step of forming said ornaments said ornaments are cast.

5. The method of claim 1 wherein in said step of forming said base, said base is comprised of at least one ornament.

* * * * *